US005609499A

United States Patent [19]

Tan et al.

[11] Patent Number: 5,609,499

[45] Date of Patent: Mar. 11, 1997

[54] CABLE CONNECTOR ASSEMBLY WITH REINFORCEMENT STRUCTURE

[75] Inventors: Haw-Chan Tan; Frank C. Ma, both of Diamond Bar, Calif.; Chin T. Lai, Tao-Yuan Hsien, Taiwan

[73] Assignee: Hon Hai Precision Ind. Co., Ltd., Taiwan

[21] Appl. No.: 515,129

[22] Filed: Aug. 15, 1995

[51] Int. Cl.[6] ..... H01R 13/58

[52] U.S. Cl. ..... 439/445; 439/455; 439/493; 439/353; 439/731

[58] Field of Search ..... 439/465, 493, 439/358, 357, 862, 945, 76, 77

[56] References Cited

U.S. PATENT DOCUMENTS

| | | | |
|---|---|---|---|
| D. 351,135 | 10/1994 | Kurata | 439/76 |
| 4,747,785 | 5/1988 | Roberts et al. | 439/465 |
| 4,838,810 | 6/1989 | Yoshimura et al. | 439/358 |
| 5,190,471 | 3/1993 | Barile et al. | 439/862 |

*Primary Examiner*—Neil Abrams
*Assistant Examiner*—Eugene G. Byrd

[57] ABSTRACT

A cable connector assembly (10) includes a cable connector kit (12) which comprises an elongated housing having a plurality of contacts (18) therein for engagement with a complementary I/O connector of an I/O card. A PC board (24) is positioned behind the cable connector kit (12) and electrically connected thereto via solder joints with contact tails of the connector kit (12). A cable unit (80) encloses a plurality of wires (82) for being soldered on the rear side of the PC board (24). A pair of covers (40) sandwich therebetween and enclose therein the connector kit (12) and PC board (24) with a coupling section of the connector kit (12) protruding out an front opening (51) of the covers (40). The cable unit (80) comprises an engagement device which can incorporate a hollow (99) defined by two covers (40) to form strain relief means to resist improper pulling force applied to the cable connector assembly (10). The covers (40) further more comprise recesses (52) to cooperate with the internal connector kit (12) for enhancing combined structure between the connector kit (12) and covers (40).

9 Claims, 3 Drawing Sheets

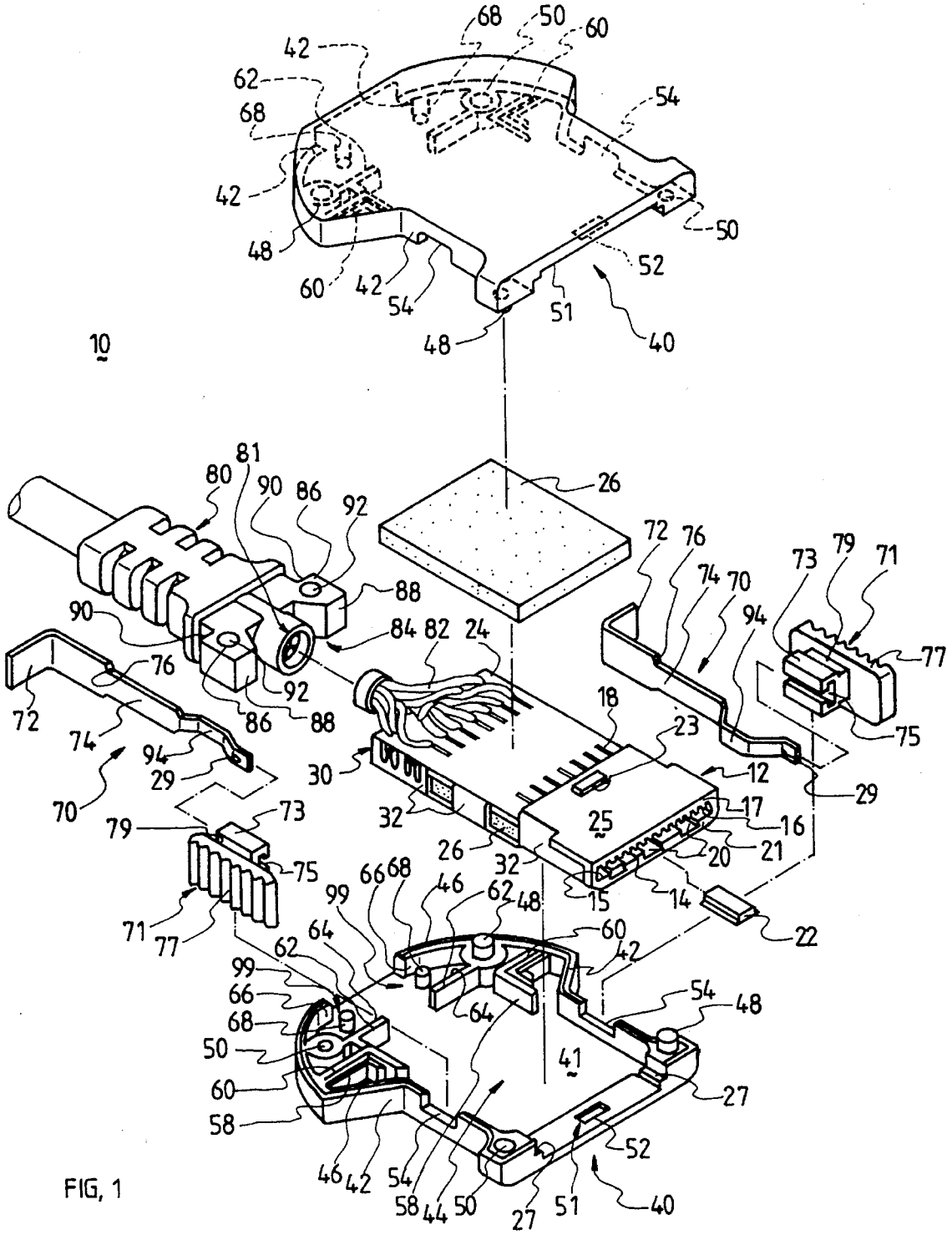
FIG, 1

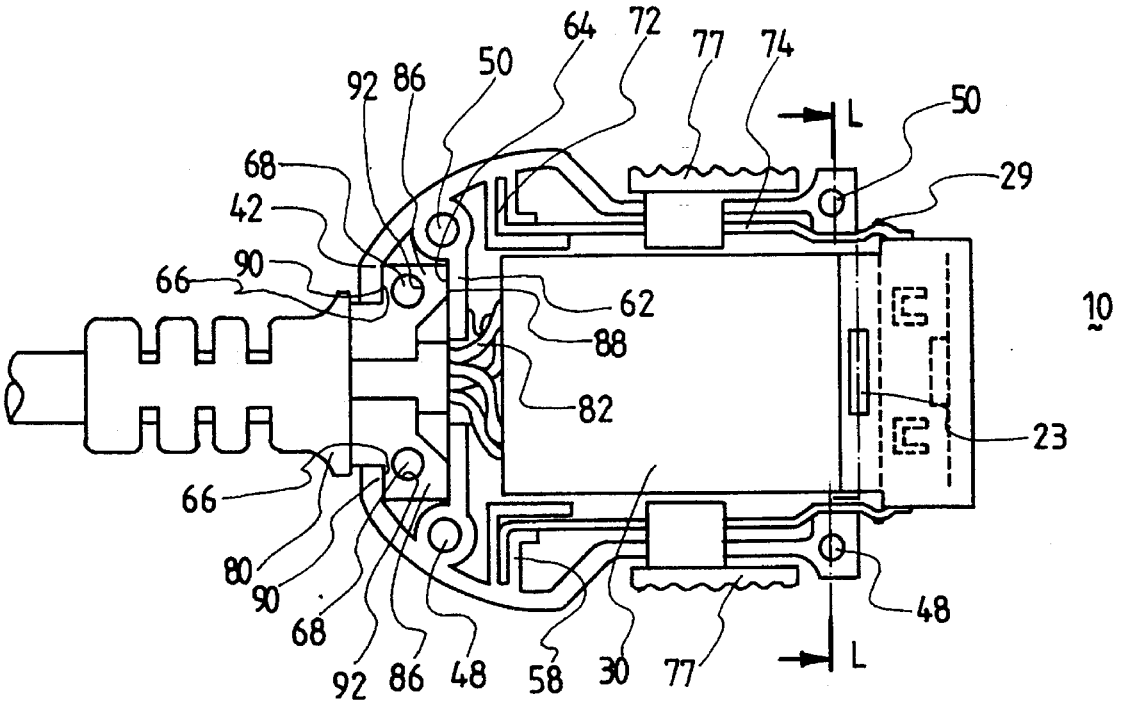
FIG, 2
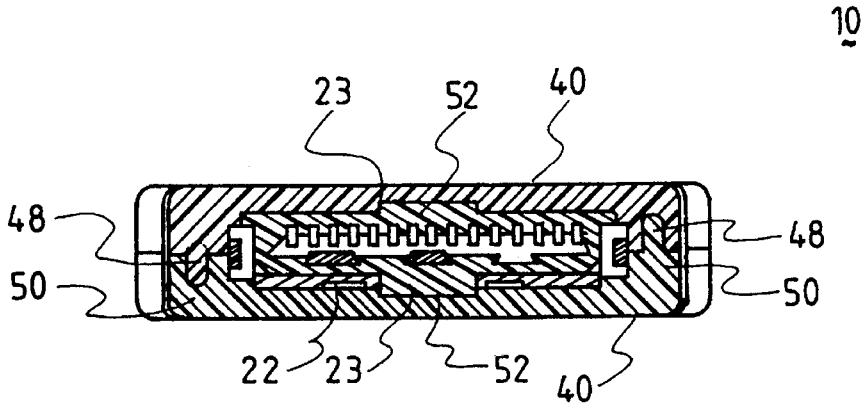
FIG, 3

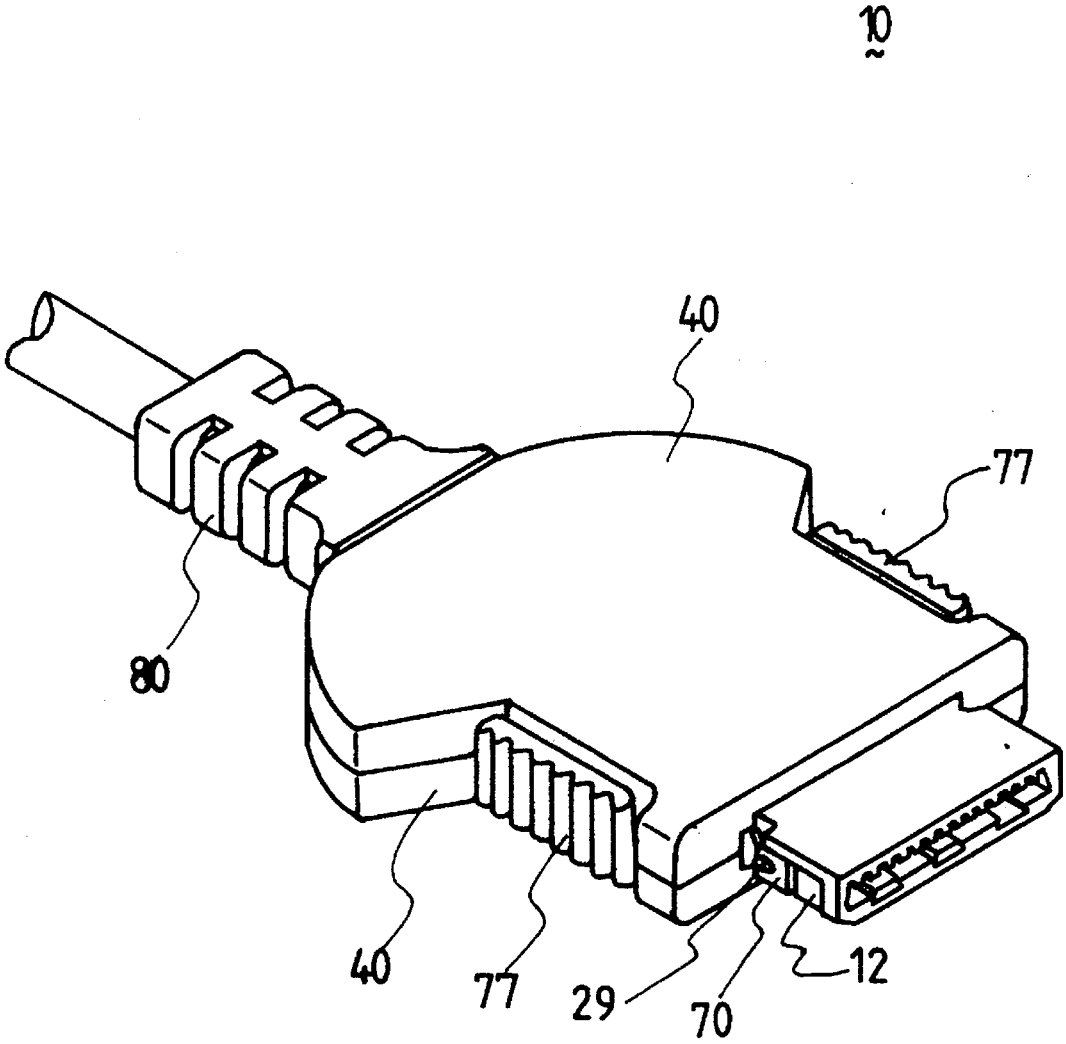
FIG,4

CABLE CONNECTOR ASSEMBLY WITH REINFORCEMENT STRUCTURE

BACKGROUND OF THE INVENTION

1. Field of the Invention

The invention relates to cable connector assemblies, particularly to the cable connector assembly for use with an I/O card wherein said cable connector has reinforcement mechanism including strain relief means for efficiently resisting pulling force applied thereto.

2. The Prior Art

U.S. Des. Pat. No. 351,135 discloses a cable connector assembly for use with an I/O card having therein an I/O connector as shown in U.S. Des. Pat. No. 351,136. The generally disadvantages of such conventional cable connector assembly may include as follows:

(1) the cable connector assembly lacks efficient strain relief means for resisting improper pulling force applied thereto;

(2) the upper cover and the lower cover are combined via screws or latches that may be worn out and then loosen after a long run use, thus resulting in shorting the life time of the cable connector assembly; and (3) to prevent shorting between the contact tails on the PC board which is positioned in the cable connector assembly, glue may be intrusively applied thereon to cover regions after the contact tails have been soldered onto the PC board. Unfortunately, the pressure due to this glue intrusion may damage the tiny structure of the contact tails or the solder joints.

Therefore, an object of the invention is to provide a cable connector assembly having an efficient strain relief mechanism for preventing excessive force transferred to the internal contacts or solder joints when an improper large pulling force applied thereto.

Another object of the invention is to provide a cable connector assembly having a reinforced structure for resisting severe environmental factors.

Yet an object of the invention is to provide a cable connector assembly which is easily made and assembled.

SUMMARY OF THE INVENTION

According to an aspect of the invention, a cable connector assembly includes a connector kit which comprises an elongated housing having a plurality of contacts therein for engagement with a complementary I/O connector of an I/O card. A PC board is positioned behind the connector kit and electrically connected thereto via solder joints with contact tails of the connector kit. A cable unit encloses a plurality of wires for being soldered on the rear side region of the PC board. A pair of covers sandwich therebetween and enclose therein the connector kit and PC board with a coupling section of the connector kit protruding out a front opening of the covers. The cable unit comprises a pier block which can incorporate a hollow defined by two covers to form strain relief means to resist improper pulling force applied to the cable connector assembly. The covers further more comprise retention means, i.g., recesses, to cooperate with the internal connector kit for enhancing combined structure between the connector kit and covers.

BRIEF DESCRIPTION OF THE DRAWINGS

FIG. 1 is an exploded perspective view of an presently preferred embodiment of a cable connector assembly according to the present invention.

FIG. 2 is a bottom view of the assembled cable connector assembly of FIG. 1 with removal of the bottom cover therefrom to show the structural engagement among the respective components.

FIG. 3 is a cross-sectional view of the assembled cable connector assembly of FIG. 1 along line L—L of FIG. 2 to show the engagement between the top cover and bottom cover, and the engagement between the connector kit and the covers.

FIG. 4 is a perspective view of the assembled cable connector assembly of FIG. 1.

DETAILED DESCRIPTION OF THE PREFERRED EMBODIMENTS

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiment. It is directed to FIGS. 1–3 wherein a cable connector assembly 10 comprises a connector kit 12 made of insulative plastics defining therein a cavity 14 having an opening 15 facing forward for receiving therein a complementary I/O card connector as shown in U.S. Des. Pat. No. 351,136.

A plurality of passageways 16 are side by side formed on the top wall surface 17 for receiving a corresponding number of contacts 18 therein for electrical engagement with the corresponding contacts of the complementary I/O connector which is inserted into the cavity 14. Oppositely, a plurality of keyways 20 are formed on the bottom wall surface 21 for selectively receiving at least one key 22 therein in order to connect to the right I/O connector which has the complementary keys thereof for properly mating with the cable connector assembly 10.

A board 24 is horizontally disposed behind the connector kit 12 with the tails of the contacts 18 are soldered thereon at its front end such that the connector kit 12 and the board 24 are electrically and mechanically connected as one piece. A plurality of tiny wires 82 extending from an interior of the cable unit 80 are solderably attached adjacent to the rear end region of the board 24 wherein such cable unit 80 has a circular jacket 81 enclosing the plural wires 82 therein. To protect the solder joints of the contacts 18 and the wires 82 on the board 24, a pair of spongy adhesives 26 are applied to the two opposite surfaces 28 of the board 24, i.e., such pair of spongy adhesives 26 sandwiching the board 24 therebetween. Moreover, to reinforce the structure formed among the board 24, the adhesives 26 and connector kit 12, a reinforcement metal plate 30 is imposed onto the bottom side of such combination. Such reinforcement plate 30 includes several upward extending paws 32 on its lateral sides for securely grasping therebetween the connector kit 12, the board 24 and the adhesives 26 in position. It should be noted that in FIG. 1, to simplify the illustration, the board 24, the bottom adhesive 26 and the reinforcement plate 30, the connector kit 12 and the plurality of the wires 82 of the cable unit 80 are assembled as one semi-finished unit. In fact, they are separate components made in manufacturing.

The cable unit 80 includes an engagement section 84 approximate its front end, which is formed of a pair of pier blocks 86 defining a front face 88, a rear face 90 and a securing hole 92 extending vertically wherein such pier blocks 86 are substantially horizontally diametrically positioned on two opposite sides of the round jacket 81. It should be understood that it is only to ease illustration the structure of the cable unit 80, the plurality of wires 82 are cut-away and detached from the cable unit 80. In fact, such plural wires 82 are inherently integral with the cable unit 80 and should be always deemed as one piece.

A pair of identical top and bottom covers 40 are generally secured to the top side and the bottom side of the combination of the connector kit 12, the board 24, the pair of adhesives 26, the reinforcement plate 30 and the pair of pier blocks 86 of the cable unit 80 for protectively enclosing such combination therein. Each cover 40 includes the circumferential walls 42 to form a cavity 44 therein to generally the aforementioned combination. Rib structures 46 extend along the top edges of the walls 44 of covers 40 for securing to each other for sealing such two covers together via high frequency welding process.

Each cover 40 has plural protrusions 48 and apertures 50 wherein the protrusions 40 of one cover 40 may be received in the corresponding apertures 50 of the other cover 40 for alignment and retention consideration when these two covers 40 are combined together. Each cover 40 includes an opening 51 at its front end to form passageway for allowing the connector kit 12 to forward extend to be exposed for engagement with the complementary I/O connector (see FIGS. 2 and 4). A pair of recesses 52 are formed in the covers 40 adjacent the front end for receiving the projections 23 formed on the opposite outer surfaces 25 of the connector kit 12, such that the connector kit 12 may be retained in position with regard to the covers 40 without possibility of movement in a front-to-end direction. A pair of indents 54 are formed on two sides of each cover 40 to allow a pair of pressing buttons 71 of a pair of latches 70 to extend through.

A pair of retention walls 58 are formed in the interior and on two sides of each cover 40 with L-shaped retention slots 60 therein, respectively, each for retainably receiving the L-shaped restriction section 72 of the latch 70. Each latch 70 includes a main strip body 74 and the aforementioned L-shaped restriction section 72 with a step 76 formed therebetween. Each pressing button 71 has a retaining section 73 having a channel 75 for interferential engagement with the main strip body 74 wherein the retaining section 73 generally abuts against the step 76. The pressing button 71 further includes a pressing section 77 exposed to an exterior for accessing, and an intermediate section 79 positioned between the pressing section 77 and the retaining section 73, which may extend through the indents 54 of the covers 40 laterally, and also be restrained within the indents 54 of the covers 40 in the vertical and/or the front-to-end directions. Referring to FIGS. 1, 2 and 4, the latch 70 further includes an offset section 94 in front of the main body 74 to extend through corresponding shoulders 27 formed by two sides of the opening 51 of the covers 40 with a dimple 29 at its front end for latchable engagement with the corresponding indentation of the complementary I/O connector (not shown).

Each cover 40 further includes a pair of restriction bars 62 on the rear portion to each define a third face 64 corresponding to the first face 88 of the pier block 86. The circumferential wall 42 defines a pair of fourth face 66 corresponding to the second face 90 of the pier block 86. Additionally, a pair of posts 68 extend vertically from the inner surface 41 of each cover 40 for receipt within the corresponding holes 92 in the pier blocks 86. In other words, via the structure defined by the third faces 64 of the restriction bars 62, the fourth face 66 of the circumferential wall 42 and the posts 68, the pier blocks 86 of the cable unit 80 may properly compliantly retainably received within the hollows 99 formed by the third faces 64 and the fourth faces 66 of the covers 40, thus forming strain relief means to isolate any improper pulling force transferred from the cable end of the cable unit 80 into the interior of the connector kit 12 for protecting the tiny contacts 18 or the solder joints on the board 26.

It can be understood that as mentioned before, the top cover 40 and the bottom cover 40 are the same structure and cooperate with each other, so that the combination of the connector kit 12, the board 24, the spongy adhesives 26, the reinforcement plate 30, the latches 70 and the cable unit 80, is substantially commonly received within the interior defined between these two covers 40.

As assembled, the cable connector assembly 10 may be detachably connected to the complementary I/O connector (not shown) by depressing inwardly the pressing sections 77 of the pressing buttons 71 of the latches 70 on two sides. Therefore, the latches 70 may be deflected toward each other by means of their resiliency applied to the support points, i.e., L-shaped sections 58. After the cable connector assembly 10 and the complementary I/O connector are fully connected to each other, by releasing the pressing buttons 71 of the latches 70, these two connector devices may be latched with each other with their interlocking means.

It is contemplated that by means of cooperation of the protrusions 48 and the apertures 50 of the covers, two covers 40 can be fixed in position with regard to each other in the front-to-end direction; by means of cooperation of the recesses 52 of the covers 40 and the projections 23 of the connector kit 12, the connector kit 12 and covers 40 can be fixed in position with regard to each other in the front-to-end direction; and by means of cooperation of the pier blocks 86 of the cable unit 80 and the hollows 99 in the covers 40, the cable unit 80 and the covers 40 may be fixed in position with regard to each other in the front-to-end direction. Additionally, such two covers are sealed via welding to prevent any vertical movements of the components so that the whole package of the cable connector assembly 10 is securely assembled without any improper relative movements among those components.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A cable connector assembly for use with an I/O connector in an I/O card, comprising:

a pair of top and bottom covers;

a connector kit having an insulative housing defining a cavity for receiving said I/O connector therein;

a plurality of contacts side by side positioned within the housing;

a board disposed behind the connector kit with tails of the contacts of the connector kit mounted thereon;

a cable unit with a tubular jacket enclosing a plurality of wires electrically connected to said board;

a pair of pier blocks positioned on the cable unit and substantially by two horizontally diametrically opposite sides of said jacket, each pier block further including a hole therein;

at least a hollow formed by said covers having therein at least a pair of opposite posts vertically extending wherein said pier blocks of the cable unit may be properly retainably received within said hollow with the posts of the hollow extending through the corresponding holes in the pier blocks, respectively, and functions as strain relief means.

2. The cable connector assembly as described in claim 1, wherein a pair of spongy adhesives are applied onto opposite sides of the board for protection.

3. The cable connector assembly as described in claim 2, wherein a reinforcement plate is attached onto one of the spongy adhesives for enhancing the structure among the connector kit, the board, the wires thereon and the spongy adhesives.

4. The cable connector assembly as described in claim 1, wherein a pair of latches are received within covers, each latch having a main strip body to incorporate a pressing button operatable in an exterior, a L-shaped section for retaining said latch therein, and an offset section having a dimple thereon for engagement with the complementary I/O connector.

5. The cable connector assembly as described in claim 4, wherein said pressing button includes a pressing section, a retaining section, and intermediate section therebetween whereby said intermediate section may extend through an indent formed on at least one side of the covers.

6. The cable connector assembly as described in claim 1, wherein each cover comprises at least one recess therein for receiving at least one projection formed on the connector kit.

7. A cable connector assembly (10) comprising a pair of covers (40) for sandwiching a connector kit (12) therebetween, a cable unit (80) attached to rear portions of the covers (40), a pair of latches (70) respectively positioned on two sides of the covers (40), wherein each of said latches (70) comprises a main body (74) to which a pressing button (71) is securely attached from an exterior, an L-shaped restriction section (72) at an rear end and an offset section (94) at a front end, and the covers (40) include retention walls (58) on rear portions, indents (54) on middle portions, and shoulders (27) on front portions, for engagement with the said restriction sections (72), pressing buttons (71), and offset sections (94) of the corresponding latches, respectively.

8. The cable connector assembly (10) as described in claim 7, wherein each of said pressing button (71) includes a retaining section (73) having a channel (75) to receive the main body (74) of the latch (70) therein, a pressing section (77), and an intermediate section (79) positioned therebetween, and wherein said intermediate section (79) substantially engages said indent (54) of the covers (40).

9. The cable connector assembly as described in claim 7, wherein the retention walls (58) of the cover (40) has a L-shaped retention slot (60) therein for conformably receiving said L-shaped restriction section (72) of the latch (70) therein.

* * * * *